US009377709B2

(12) United States Patent
Nozaki et al.

(10) Patent No.: US 9,377,709 B2
(45) Date of Patent: Jun. 28, 2016

(54) TONER AND METHOD OF MANUFACTURING THE SAME

(71) Applicant: KYOCERA Document Solutions Inc., Osaka (JP)

(72) Inventors: Takatoshi Nozaki, Osaka (JP); Noriaki Sakamoto, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 14/604,878

(22) Filed: Jan. 26, 2015

(65) Prior Publication Data

US 2015/0212441 A1 Jul. 30, 2015

(30) Foreign Application Priority Data

Jan. 27, 2014 (JP) ..... 2014-012346

(51) Int. Cl.
*G03G 9/08* (2006.01)
*G03G 9/093* (2006.01)

(52) U.S. Cl.
CPC ..... *G03G 9/09307* (2013.01); *G03G 9/09314* (2013.01); *G03G 9/09321* (2013.01); *G03G 9/09342* (2013.01); *G03G 9/09392* (2013.01)

(58) Field of Classification Search
CPC ..... G03G 9/09342; G03G 9/09314; G03G 9/09392
USPC ..... 430/110.2
See application file for complete search history.

(56) References Cited

FOREIGN PATENT DOCUMENTS

JP 2006-215151 A 8/2006

*Primary Examiner* — Mark A Chapman
(74) *Attorney, Agent, or Firm* — Studebaker & Brackett PC

(57) ABSTRACT

A toner contains a plurality of toner particles. Each of the toner particles includes a toner core containing a binder resin, a shell layer disposed over a surface of the toner core, internal particles located within the shell layer, and an external additive located on a surface of the shell layer. Each of the toner particles has 4 to 169 projections resulting from the internal particles and having a height of no less than 40 nm and no greater than 200 nm when a 1-$\mu m^2$ region of the surface of the toner particle is observed, and the projections satisfy the following equation (1)

$$\{(1000/2Y)-0.5\}^2 \leq X \leq \{(1000/2Y)+0.5\}^2 \quad (1)$$

wherein X represents the number of the projections, and Y represents the height of the projections.

6 Claims, 3 Drawing Sheets

TONER AND METHOD OF MANUFACTURING THE SAME

INCORPORATION BY REFERENCE

The present application claims priority under 35 U.S.C. §119 to Japanese Patent Application No. 2014-12346, filed Jan. 27, 2014. The contents of this application are incorporated herein by reference in their entirety.

BACKGROUND

The present disclosure relates to a toner and a method of manufacturing the toner, and in particular relates to a capsule toner and a method of manufacturing the capsule toner.

A capsule toner obtained by coating toner cores with shell layers (capsule layers) is used in electrophotographic image formation. In a known capsule toner, shell layers contain particles.

SUMMARY

A toner of the present disclosure contains a plurality of toner particles. Each of the toner particles includes a toner core containing a binder resin, a shell layer disposed over a surface of the toner core, internal particles located within the shell layer, and an external additive located on a surface of the shell layer. Each of the toner particles has 4 to 169 projections resulting from the internal particles and having a height of no less than 40 nm and no greater than 200 nm when a 1-$\mu m^2$ region of the surface of the toner particle is observed, and the projections satisfy the following equation (1)

$$\{(1000/2Y)-0.5\}^2 \leq X \leq \{(1000/2Y)+0.5\}^2 \quad (1)$$

wherein X represents the number of the projections, and Y represents the height of the projections.

A method of manufacturing a toner of the present disclosure includes in order: attaching internal particles to surfaces of toner cores; forming shell layers over the surfaces of the toner cores in such a manner that the internal particles are located within the shell layers; and attaching an external additive to surfaces of the shell layers to give toner particles. In the attaching internal particles, the internal particles are attached so that each of the toner particles has 4 to 169 projections resulting from the internal particles and having a height of no less than 40 nm and no greater than 200 nm when a 1-$\mu m^2$ region of the surface of the toner particle is observed, and the projections satisfy the following equation (1)

$$\{(1000/2Y)-0.5\}^2 \leq X \leq \{(1000/2Y)+0.5\}^2 \quad (1)$$

wherein X represents the number of the projections, and Y represents the height of the projections.

DETAILED DESCRIPTION

Hereinafter, an embodiment of the present disclosure will be described in detail. The present disclosure is in no way limited to the embodiment below, and various alterations may be made to practice the present disclosure within the scope of the aim of the present disclosure. It should be noted that explanation is omitted where appropriate in order to avoid repetition, but such omission does not limit the gist of the present disclosure.

A toner according to the present embodiment is a capsule toner for developing an electrostatic latent image. The toner of the present embodiment is a powder containing a plurality of particles (hereinafter, referred to as toner particles). The toner according to the present embodiment can be used in an electrophotographic apparatus, for example.

The electrophotographic apparatus develops an electrostatic latent image with a developer that includes the toner. As a result of the development, charged toner adheres to the electrostatic latent image formed on a photosensitive member. The adhered toner is then transferred onto an intermediate transfer member (e.g., transfer belt) to form a toner image. Subsequently, the toner image on the intermediate transfer member is transferred onto a recording medium (e.g., paper). Thereafter, the toner is heated and fixed onto the recording medium. Thus, an image is formed on the recording medium. A full-color image can be formed through superimposition of toner images formed with black, yellow, magenta, and cyan toners, for example.

Figure 1:
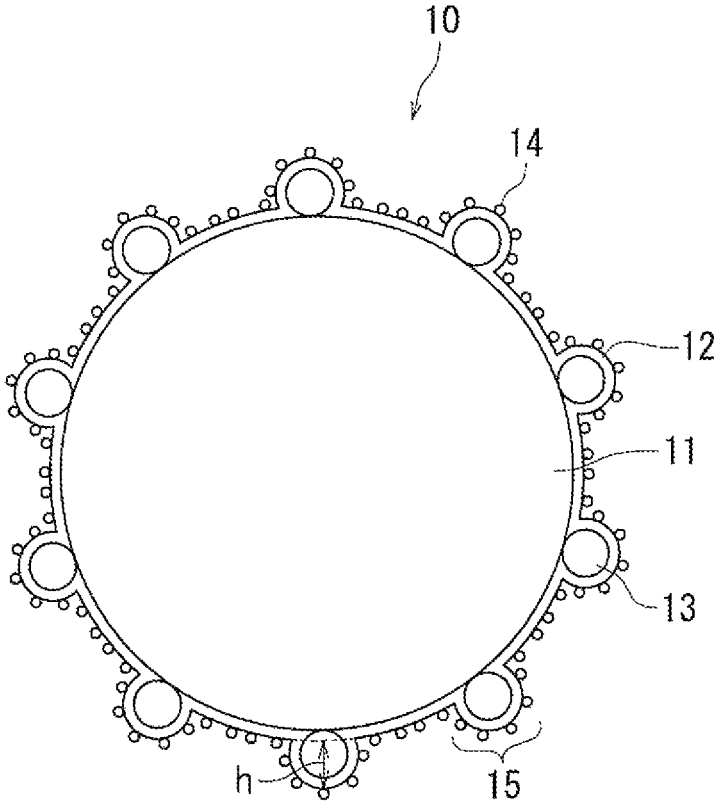
FIG. 1 is a diagram illustrating a toner particle contained in a toner according to an embodiment of the present disclosure.

Hereinafter, a plurality of toner particles contained in the toner of the present embodiment will be described with reference to FIG. 1. FIG. 1 illustrates one of toner particles 10 contained in the toner according to the present embodiment. As shown in FIG. 1, the toner particle 10 contains a toner core 11, a shell layer 12, internal particles 13, and an external additive 14. The shell layer 12 is formed over a surface of the toner core 11. The internal particles 13 are located within the shell layer 12.

The toner core 11 contains a binder resin. The shell layer 12 is formed over the surface of the toner core 11. The external additive 14 is attached to the surface of the shell layer 12. Hereinafter, the toner particle before the attachment of the external additive 14 may be referred to as a toner mother particle.

The toner particle 10 may not contain any internal additive if unnecessary. The toner particle 10 may have a plurality of shell layers 12 on the surface of the toner core 11. That is, the shell layer 12 may be single-layer or multi-layer.

The shell layer 12 formed over the surface of the toner core 11 enhances blocking resistance, transportability, or preservability of the toner particle 10. The shell layer 12 also prevents the internal particles 13 from shedding from the toner particle 10. The shell layer 12 is broken once the toner particle 10 is supplied onto a recording medium such as paper, and heat and a load is applied thereto. The toner core 11 then comes out through the broken shell layer 12 and melts or softens to be fixed onto the recording medium.

The toner particle 10 contains the internal particles 13 located within the shell layer 12. The surface of the toner particle 10 therefore has projections 15 resulting from the internal particles 13. With the projections 15, the external additive 14 can be prevented from being embedded in the shell layer 12 because of stress (pressure) or the like applied thereto when added. As a result, the toner particle 10 can maintain appropriate chargeability over a long period of time.

The shell layer 12 has the projections 15. Hereinafter, a specific example of how to determine the distribution of the projections 15 (the height h of the projections and the number of the projections) will be described.

The toner particle 10 without the external additive 14 is observed using a scanning probe microscope (SPM) (e.g., "S-image", product of Hitachi High-Tech Science Corporation) for the distribution of the projections 15 on the surface of the toner particle 10. Specifically, the projections 15 are observed region A by region A of the surface of the toner particle 10. The plurality of regions A each have an area of 1 $\mu m^2$ (1 μm×1 μm). The distribution of the projections 15 may be observed before the external additive 14 is attached to the shell layer 12 or after the attached external additive 14 has been removed from the shell layer 12. For example, the external additive 14 can be removed from the shell layer 12 by dissolving the external additive 14 in an alkaline solution (e.g., aqueous sodium hydroxide solution). Alternatively, the external additive 14 may be removed from the shell layer 12 using an ultrasonic cleaner, for example.

An example of how to remove the external additive 14 from the shell layer 12 using an ultrasonic cleaner will be described. First, the toner particles 10 are dispersed in ethanol or an aqueous surfactant solution using an ultrasonic cleaner. The external additive 14 is separated from each toner mother particle by ultrasound. Subsequently, the dispersion is filtered by suction through a filter having a pore size of 5 μm. Through the filtering, the particles of the external additive 14 pass through the filter, and the toner mother particles remain on the filter. Subsequently, the toner mother particles are collected and dried. Thereafter, the surface of each toner mother particle is observed using an electron microscope. If the external additive 14 has not been removed sufficiently, the above-described dispersing, filtering, and drying are repeated until the external additive 14 is removed sufficiently.

The surface roughness of a substantially whole area of each region A (surface of the toner particle 10) is measured continuously by scanning the region A using the scanning probe microscope. A surface roughness in maximum height is determined for each toner, and an average of surface roughness values of ten toner particles 10 is used as the surface roughness. Subsequently, toner particles 10 are prepared by forming the shell layers 12 having the same thickness without including the internal particles 13 (forming the shell layers 12 directly over the toner cores 11) and measured for the surface roughness in the above-described manner. The height h of the projections is determined in accordance with the following equation (I).

Height $h$ of projections=(surface roughness of toner particle 10 including internal particles 13 within shell layer 12)−(surface roughness of toner particle 10 including no internal particles 13 within shell layer 12) I Alternatively, the height h of the projections of the toner mother particles from which the external additive 14 has been removed as described above may be determined by scanning each region A (surface of the toner particle 10) using the scanning probe microscope and thus measuring a substantially whole area of the region A continuously. In this case, an average value of heights h of the projections in ten toner particles 10 can be used.

Specifically, the distribution of the projections 15 in the surface of the toner particle 10 of the present embodiment is as follows. That is, the toner particle 10 has 4 to 169 projections 15 having a height of no less than 40 nm and no greater than 200 nm in each region A.

In addition, the distribution of the projections 15 in the present embodiment satisfies the following equation (1).

$$\{(1000/2Y)-0.5\}^2 \leq X \leq \{(1000/2Y)+0.5\}^2 \quad (1)$$

In the equation (1), X represents the number of the projections 15, and Y represents the height h of the projections 15.

Satisfying the above-described distribution (the height h of the projections 15 and the number of the projections 15) of the projections 15, the toner containing the toner particles 10 of the present embodiment has a sufficient spacer function, and thus the external additive 14 is prevented from being embedded in the shell layer 12. The toner can therefore maintain stable chargeability and have an enhanced anti-fogging property and enhanced durability.

Preferably, the toner of the present embodiment contains no less than 80% by number of toner particles 10, more preferably no less than 90% by number of toner particles 10, and still more preferably 100% by number of toner particles 10.

Preferably, the toner core 11 is anionic, and a material of the shell layer 12 is cationic. As a consequence of the toner core 11 being anionic, the cationic material of the shell layer 12 can be attracted toward the surface of the toner core 11 during formation (film formation) of the shell layer 11. Specifically, the material of the shell layer 12 positively charged in an aqueous medium is electrically attracted by the toner core 11 negatively charged in the aqueous medium, for example, and the shell layer 12 is formed over the surface of the toner core 11 through an in-situ polymerization, for example. As a result, the shell layer 12 can be readily formed in a uniform manner on the surface of the toner core 11 without needing to use a dispersant in order to achieve a high degree of dispersion of the toner cores 11 in the aqueous medium.

A binder resin accounts for a large proportion (e.g., no less than 85% by mass) of the components of the toner core 11. Therefore, the polarity of the binder resin has a significant influence on the overall polarity of the toner core 11. For example, when the binder resin has an ester group, a hydroxyl group, an ether group, an acid group, or a methyl group, the toner core 11 has a strong tendency to be anionic. On the other hand, when the binder resin has an amino group, an amine, or an amide group, for example, the toner core 11 has a strong tendency to be cationic.

In the present embodiment, the zeta potential of the toner core 11 having a negative polarity when measured in an aqueous medium adjusted to pH 4 is used as an indicator that the toner core 11 is anionic. In order to strengthen bonding between the toner core 11 and the shell layer 12, the toner core 11 preferably has a zeta potential at pH 4 of less than 0 V, and the toner particle 10 preferably has a zeta potential at pH 4 of greater than 0 V. It should be noted that in the present embodiment, a pH of 4 is the same as the pH of the aqueous medium during formation of the shell layer 12.

Examples of methods of measuring the zeta potential include an electrophoresis method, an ultrasonographic method, and an electrokinetic sonic amplitude (ESA) method.

In the electrophoresis method, an electric field is applied to a dispersion of particles, thereby causing electrophoretic migration of charged particles in the dispersion, and the zeta potential is calculated based on the rate of electrophoretic migration. Examples of the electrophoresis method include laser Doppler electrophoresis (a method in which migrating particles are irradiated with laser light and the rate of electrophoretic migration of the particles is calculated from an amount of Doppler shift of scattered light obtained). Advantages of laser Doppler electrophoresis are a lack of necessity for particle concentration in the dispersion to be high, a low number of parameters being necessary for calculating the zeta potential, and a high degree of sensitivity in detection of the rate of electrophoretic migration.

The ultrasonographic method involves irradiating a dispersion of particles with ultrasound, thereby causing vibration of electrically charged particles in the dispersion, and calculating the zeta potential based on an electric potential difference that arises due to the vibration.

The ESA method involves applying a high frequency voltage to a dispersion of particles, thereby causing electrically charged particles in the dispersion to vibrate and generate ultrasound. The zeta potential is calculated from the magnitude (intensity) of the ultrasound.

An advantage of the ultrasonographic method and the ESA method is that the zeta potential can be measured with a high degree of sensitivity even when the concentration of the particles in the dispersion is high (e.g., greater than 20% by mass)

Hereinafter, the toner cores 11, the shell layers 12, the internal particles 13, and the external additive 14 will be described in order with reference mainly to FIG. 1.

The toner cores 11 contain a binder resin. The toner cores 11 may contain an internal additive (e.g., a colorant, a releasing agent, a charge control agent, or a magnetic powder). For example, the toner cores 11 may contain one or more internal additives selected from a colorant, a releasing agent, a charge control agent, and a magnetic powder.

Hereinafter, the binder resin will be described. In order that the binder resin is strongly anionic, the binder resin preferably has a hydroxyl value (OHV) and an acid value (AV) that are each no less than 10 mg KOH/g, and more preferably no less than 20 mg KOH/g.

Preferably, the binder resin has a glass transition point (Tg) that is no greater than the curing initiation temperature of a thermosetting resin contained in the shell layers 12. Such a binder resin is likely to provide sufficient fixability even in high-speed fixing. Typically, the curing initiation temperature of the thermosetting resin (in particular, a melamine-based resin) is approximately 55° C. The binder resin preferably has a Tg of no less than 20° C., more preferably no less than 30° C. and no greater than 55° C., and still more preferably no less than 30° C. and no greater than 50° C. When the binder resin has a Tg of no less than 20° C., the toner cores 11 have a low tendency to aggregate during formation of the shell layers 12.

Figure 2:
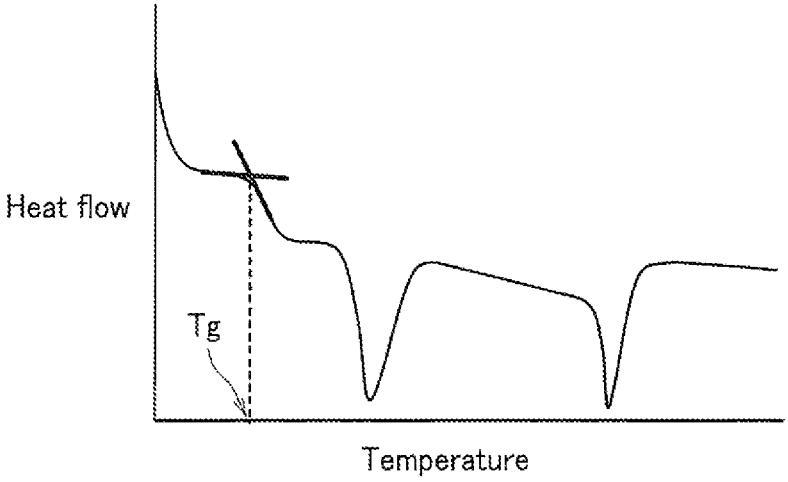
FIG. 2 is graphic representation for illustrating how to read a glass transition point Tg from a heat absorption curve.

The Tg of the binder resin can be read from a heat absorption curve. Hereinafter, a method of reading the Tg of the binder resin from a heat absorption curve will be described with reference mainly to FIG. 2. FIG. 2 shows an example of the heat absorption curve.

The Tg can be measured as follows. A heat absorption curve is obtained using a differential scanning calorimeter (e.g., "DSC-6220", product of Seiko Instruments Inc.) For example, a heat absorption curve such as shown in FIG. 2 is obtained. The Tg of the binder resin can be calculated from an inflection point of specific heat in the heat absorption curve of the binder resin.

The binder resin preferably has a softening point (Tm) of no greater than 100° C., and more preferably no greater than 95° C. The binder resin having a Tm of no greater than 100° C. (more preferably no greater than 95° C.) can provide sufficient fixability even in high-speed fixing. The binder resin having a Tm of no greater than 100° C. (more preferably no greater than 95° C.) encourages the toner cores 11 to partially soften in the formation of the shell layers 12 over the surfaces of the toner cores 11 in an aqueous medium. Accordingly, the toner cores 11 have a high tendency to adopt a spherical shape due to surface tension. The Tm of the binder resin can be adjusted through combination of a plurality of resins having different Tms.

Figure 3:
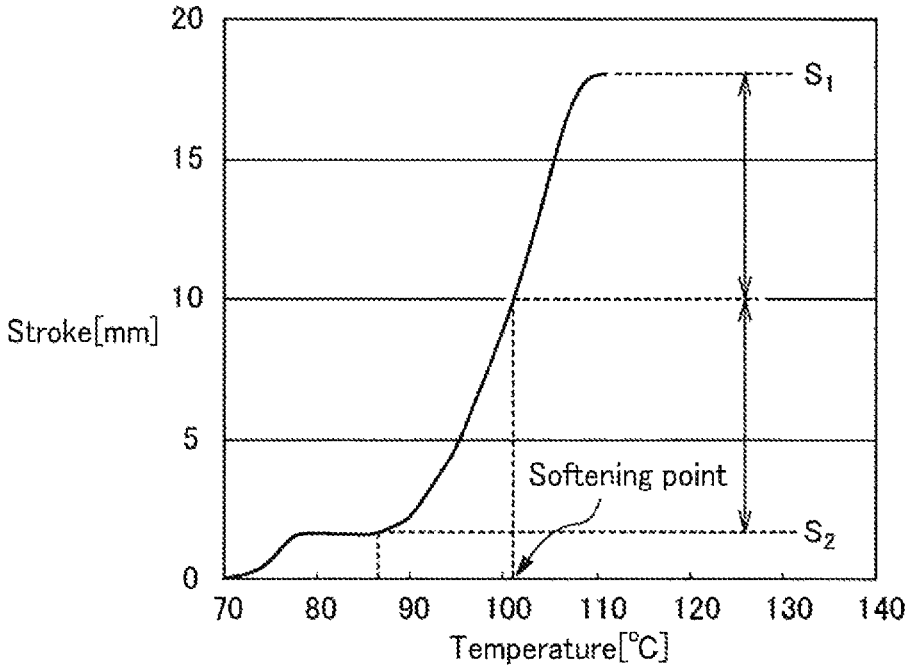
FIG. 3 is a graphic representation for illustrating how to read a softening point Tm from an S-shaped curve.

The Tm of the binder resin can be read from an S-shaped curve. Hereinafter, a method of reading the Tm of the binder resin from an S-shaped curve will be described with reference to FIG. 3. FIG. 3 shows an example of the heat absorption curve.

The Tm of the binder resin can be measured using a capillary rheometer (e.g., "CFT-500D", product of Shimadzu Corporation). Specifically, a measurement sample is placed in the capillary rheometer and melt flow of the sample is caused under predetermined conditions. Thus, an S-shaped curve (S-shaped curve relating temperature (° C.) to stroke (mm)) can be obtained. The Tm of the binder resin can be read from the S-shaped curve obtained. In FIG. 3, $S_1$ indicates a maximum stroke value and $S_2$ indicates a base line stroke value at low temperatures. The Tm of the measurement sample is determined to be a temperature corresponding to a point on the S-shaped curve at which the stroke is equal to $(S_1+S_2)/2$.

The description of the toner cores 11 will be continued with reference to FIG. 1.

The binder resin is preferably a resin having a functional group such as an ester group, a hydroxyl group, an ether group, an acid group, a methyl group, or a carboxyl group, for example. Preferably, the molecule of the binder resin has a functional group such as a hydroxyl group or a carboxyl group. More preferably, the molecule of the binder resin has a hydroxyl group and/or a carboxyl group. The binder resin in the toner cores 11 having such a functional group readily reacts to form chemical bonds with a material of the shell layers 12 (e.g., methylol melamine). Formation of such chemical bonds ensures that the toner cores 11 are strongly bound to the shell layers 12.

Preferably, the binder resin is a thermoplastic resin. Preferable examples of the thermoplastic resin include styrene-based resins, acrylic-based resins, styrene-acrylic-based resins, polyethylene-based resins, polypropylene-based resins, vinyl chloride-based resins, polyester resins, polyamide-based resins, polyurethane-based resins, polyvinyl alcohol-based resins, vinyl ether-based resins, N-vinyl-based resins, and styrene-butadiene based resins. In particular, styrene-acrylic-based resins and polyester resins have excellent properties in terms of colorant dispersibility in the toner, chargeability of the toner, and fixability of the toner on a recording medium.

Hereinafter, a styrene-acrylic-based resin as the binder resin will be described. A styrene-acrylic-based resin is a copolymer of a styrene-based monomer and an acrylic-based monomer, for example.

Preferable examples of the styrene-based monomer include styrene, α-methylstyrene, p-hydroxystyrene, m-hydroxystyrene, vinyltoluene, α-chlorostyrene, o-chlorostyrene, m-chlorostyrene, p-chlorostyrene, and p-ethylstyrene.

Preferable examples of the acrylic-based monomer include (meth)acrylic acid, alkyl (meth)acrylates, and hydroxyalkyl (meth)acrylates. Preferable examples of the alkyl (meth)acrylates include methyl (meth)acrylate, ethyl (meth)acrylate, n-propyl (meth)acrylate, iso-propyl (meth)acrylate, n-butyl (meth)acrylate, iso-butyl (meth)acrylate, and 2-ethylhexyl (meth)acrylate. Preferable examples of hydroxyalkyl (meth) acrylates include 2-hydroxyethyl (meth)acrylate, 3-hydroxypropyl (meth)acrylate, 2-hydroxypropyl (meth)acrylate, and 4-hydroxybutyl (meth)acrylate. It should be noted that herein the term (meth)acrylic is used as a generic term for both methacrylic and acrylic.

A hydroxyl group can be introduced into the styrene-acrylic-based resin by using a monomer having a hydroxyl group (e.g., p-hydroxystyrene, m-hydroxystyrene, or hydroxyalkyl (meth)acrylate) during preparation of the styrene-acrylic-based resin. The hydroxyl value of the styrene-acrylic-based resin can be adjusted through appropriate adjustment of the amount of the monomer having the hydroxyl group, for example.

A carboxyl group can be introduced into the styrene-acrylic-based resin using (meth)acrylic acid as a monomer in preparation of the styrene-acrylic-based resin. The acid value of the styrene-acrylic-based resin can be adjusted through appropriate adjustment of the amount of (meth)acrylic acid, for example.

The styrene-acrylic-based resin as the binder resin preferably has a number average molecular weight (Mn) of no less than 2000 and no greater than 3000 in order to improve strength of the toner cores 11 and fixability of the toner. The styrene-acrylic-based resin preferably has a molecular weight distribution (ratio Mw/Mn of mass average molecular weight (Mw) relative to number average molecular weight Mn) of no less than 10 and no greater than 20. The Mn and the Mw of the binder resin can be measured by gel permeation chromatography.

Hereinafter, a polyester resin as the binder resin will be described. A polyester resin is obtained through condensation polymerization or copolymerization of a dihydric, or tri- or higher-hydric alcohol component with a dibasic, or tri- or higher-basic carboxylic acid component, for example.

Preferable examples of the dihydric, or tri- or higher-hydric alcohol component include diols, bisphenols, and alcohols having three or more hydroxyl groups.

Preferable examples of the diols include ethylene glycol, diethylene glycol, triethylene glycol, 1,2-propanediol, 1,3-propanediol, 1,4-butanediol, neopentyl glycol, 1,4-butenediol, 1,5-pentanediol, 1,6-hexanediol, 1,4-cyclohexanedimethanol, dipropylene glycol, polyethylene glycol, polypropylene glycol, and polytetramethylene glycol.

Preferable examples of the bisphenols include bisphenol A, hydrogenated bisphenol A, polyoxyethylenated bisphenol A, and polyoxypropylenated bisphenol A.

Preferable examples of the alcohols having three or more hydroxyl groups include sorbitol, 1,2,3,6-hexanetetraol, 1,4-sorbitan, pentaerythritol, dipentaerythritol, tripentaerythritol, 1,2,4-butanetriol, 1,2,5-pentanetriol, glycerol, diglycerol, 2-methylpropanetriol, 2-methyl-1,2,4-butanetriol, trimethylolethane, trimethylolpropane, and 1,3,5-trihydroxymethylbenzene.

As the dibasic, or tri- or higher-basic carboxylic acid component, for example, a derivative having ester formation properties (e.g., a carboxylic acid halide, a carboxylic acid anhydride, or a carboxylic acid lower alkyl ester) may be used. The term "lower alkyl" used herein refers to an alkyl group having 1 to 6 carbon atoms.

Preferable examples of dibasic carboxylic acids include maleic acid, fumaric acid, citraconic acid, itaconic acid, glutaconic acid, phthalic acid, isophthalic acid, terephthalic acid, cyclohexanedicarboxylic acid, adipic acid, sebacic acid, azelaic acid, malonic acid, and succinic acid (e.g., alkyl succinic acids and alkenyl succinic acids). Preferable examples of the alkyl succinic acids include n-butyl succinic acid, isobutylsuccinic acid, n-octylsuccinic acid, n-dodecylsuccinic acid, and isododecylsuccinic acid. Preferable examples of the alkenyl succinic acids include n-butenyl succinic acid, isobutenylsuccinic acid, n-octenylsuccinic acid, n-dodecenylsuccinic acid, and isododecenylsuccinic acid.

Preferable examples of the tri- or higher-basic carboxylic acids include 1,2,4-benzenetricarboxylic acid (trimellitic acid), 1,2,5-benzenetricarboxylic acid, 2,5,7-naphthalenetricarboxylic acid, 1,2,4-naphthalenetricarboxylic acid, 1,2,4-butanetricarboxylic acid, 1,2,5-hexanetricarboxylic acid, 1,3-dicarboxyl-2-methyl-2-methylenecarboxypropane, 1,2,4-cyclohexanetricarboxylic acid, tetra(methylenecarboxyl) methane, 1,2,7,8-octanetetracarboxylic acid, pyromellitic acid, and EMPOL trimer acid.

The acid value and the hydroxyl value of the polyester resin can be adjusted through appropriate adjustment of the amount of dihydric, or tri- or higher-hydric alcohol component and the dibasic, or tri- or higher-basic carboxylic acid component, respectively, used during preparation of the polyester resin. The acid value and the hydroxyl value of the polyester resin tend to decrease with increase in the molecular weight of the polyester resin.

The polyester resin as the binder resin preferably has a number average molecular weight (Mn) of no less than 1200 and no greater than 2000 in order to improve strength of the toner cores 11 and fixability of the toner. The polyester resin preferably has a molecular weight distribution (Mw/Mn) of no less than 9 and no greater than 20.

Hereinafter, a colorant that may be contained in the toner cores 11 will be described. The colorant can be for example a known pigment or dye selected to match the color of the toner particles 10. The amount of the colorant is preferably no less than 1 part by mass and no greater than 20 parts by mass, and more preferably no less than 3 parts by mass and no greater than 10 parts by mass relative to 100 parts by mass of the binder resin.

The toner cores 11 may contain a black colorant. The black colorant may for example be composed of carbon black. Alternatively, a colorant may be used that has been adjusted to a black color using colorants such as a yellow colorant, a magenta colorant, and a cyan colorant.

The toner cores 11 may contain a non-black colorant such as a yellow colorant, a magenta colorant, or a cyan colorant.

Examples of the yellow colorant include condensed azo compounds, isoindolinone compounds, anthraquinone compounds, azo metal complexes, methine compounds, and arylamide compounds. Preferable examples of the yellow colorants include C.I. Pigment Yellow (3, 12, 13, 14, 15, 17, 62, 74, 83, 93, 94, 95, 97, 109, 110, 111, 120, 127, 128, 129, 147, 151, 154, 155, 168, 174, 175, 176, 180, 181, 191, and 194), Naphthol Yellow S, Hansa Yellow G, and C.I. Vat Yellow.

Examples of the magenta colorant include condensed azo compounds, diketopyrrolopyrrole compounds, anthraquinone compounds, quinacridone compounds, basic dye lake compounds, naphthol compounds, benzimidazolone compounds, thioindigo compounds, and perylene compounds. Preferable examples of the magenta colorant include C.I. Pigment Red (2, 3, 5, 6, 7, 19, 23, 48:2, 48:3, 48:4, 57:1, 81:1, 122, 144, 146, 150, 166, 169, 177, 184, 185, 202, 206, 220, 221, and 254).

Examples of the cyan colorant include copper phthalocyanine compounds, copper phthalocyanine derivatives, anthraquinone compounds, and basic dye lake compounds. Preferable examples of the cyan colorants include C.I. Pigment Blue (1, 7, 15, 15:1, 15:2, 15:3, 15:4, 60, 62, and 66), Phthalocyanine Blue, C.I. Vat Blue, and C.I. Acid Blue.

Hereinafter, the releasing agent will be described. The releasing agent is used in order to improve the fixability or the offset resistance of the toner. The amount of the releasing agent is preferably no less than 1 part by mass and no greater than 30 parts by mass, and more preferably no less than 5 parts by mass and no greater than 20 parts by mass relative to 100 parts by mass of the binder resin in order to improve the fixability or the offset resistance.

Examples of the releasing agent include aliphatic hydrocarbon-based waxes, oxides of aliphatic hydrocarbon-based waxes, plant waxes, animal waxes, mineral waxes, waxes having a fatty acid ester as major component, and waxes in which a part or all of a fatty acid ester has been deoxidized. Examples of the aliphatic hydrocarbon-based waxes include low molecular weight polyethylene, low molecular weight polypropylene, polyolefin copolymer, polyolefin wax, microcrystalline wax, paraffin wax, and Fischer-Tropsch wax. Examples of the oxides of aliphatic hydrocarbon-based waxes include polyethylene oxide wax and block copolymer of polyethylene oxide wax. Examples of the plant wax include candelilla wax, carnauba wax, Japan wax, jojoba wax, and rice wax. Examples of the animal wax include beeswax, lanolin, and spermaceti. Examples of the mineral wax include ozocerite, ceresin, and petrolatum. Examples of the waxes having a fatty acid ester as major component include montanic acid ester wax and castor wax. Examples of the waxes in which a part or all of a fatty acid ester has been deoxidized include deoxidized carnauba wax.

Hereinafter, the shell layers 12 will be described. Preferably, the shell layers 12 contain a thermosetting resin. The shell layers 12 preferably contain a nitrogen-containing resin or a derivative thereof as the thermosetting resin in order to improve the strength, hardness, and cationic strength of the shell layers 12. When the shell layers 12 contain nitrogen atoms, the shell layers 12 have a high tendency to be positively charged. In order to increase the cationic strength of the shell layers 12, the shell layers 12 preferably contain no less than 10% by mass of nitrogen atoms.

Preferable examples of the thermosetting resin that can be contained in the shell layers 12 include melamine resins, urea resins, sulfonamide resins, glyoxal resins, guanamine resins, aniline resins, and derivatives of any of the aforementioned resins. Preferable examples of the derivatives of the melamine resins include methylol melamine. Preferable examples of the derivatives of the guanamine resins include benzoguanamine, acetoguanamine, and spiroguanamine.

Preferable examples of the thermosetting resin that can be contained in the shell layers 12 further include polyimide resins, maleimide-based polymers, bismaleimide-based polymers, amino-bismaleimide polymers, and bismaleimide triazine polymers, which have an nitrogen atom in their polymer backbones.

In particular, the thermosetting resin that can be contained in the shell layers 12 is preferably a resin produced through polycondensation of an aldehyde (e.g., formaldehyde) and a compound having an amino group (herein referred to as an amino-aldehyde resin) or derivatives of the amino-aldehyde resin. A melamine resin is a polycondensate of melamine and formaldehyde, for example. A urea resin is a polycondensate of urea and formaldehyde, for example. A glyoxal resin is a polycondensate of formaldehyde and a reaction product of glyoxal and urea, for example.

Preferably, no less than 80% by mass of the resin contained in the shell layers 12 is the thermosetting resin, more preferably no less than 90% by mass of the resin is the thermosetting resin, and particularly preferably 100% by mass of the resin is the thermosetting resin.

The shell layers 12 preferably have a thickness of no less than 1 nm and no greater than 20 nm, and more preferably no less than 1 nm and no greater than 10 nm.

The thickness of the shell layers 12 being no greater than 20 nm enables the shell layers 12 to be easily ruptured during fixing of the toner on a recording medium through, for example, application of heat and pressure. As a result, the low-temperature fixability of the toner is improved. Furthermore, the thickness of the shell layers 12 being no greater than 20 nm prevents the chargeability of the shell layers 12 from being excessively high and thus ensures that an image is formed appropriately.

On the other hand, the thickness of the shell layers 12 being no less than 1 nm ensures that the shell layers 12 have improved strength, enabling restriction of rupturing of the shell layers 12 during transportation due to, for example, an impact.

The thickness of the shell layers 12 can be measured by analyzing transmission electron microscopy (TEM) images of cross-sections of the toner particles 10 using commercially available image-analyzing software (e.g., "WinROOF", product of Mitani Corporation).

In the present embodiment, the shell layers 12 may be cationic (positively charged). The shell layers 12 may contain a positive charge control agent.

Hereinafter, the internal particles 13 will be described. The internal particles 13 are located within each shell layer 12. The internal particles 13 located within the shell layers 12 prevent the external additive 14 from being embedded in the shell layers 12 and enable the toner particles 10 to maintain appropriate chargeability over a long period of time.

The internal particles 13 preferably have an average particle diameter of no less than 10 nm and no greater than 300 nm, and more preferably no less than 10 nm and no greater than 20 nm in order to control the distribution of the projections 15 of the toner particles 10 within a preferable range.

Examples of the internal particles 13 include organic particles and inorganic particles. In particular, the inorganic particles are preferable. Examples of the inorganic particles include silica particles and inorganic particles of a metal oxide (e.g., alumina, titanium oxide, magnesium oxide, zinc oxide, strontium titanate, and barium titanate).

Preferably, the internal particles 13 are hydrophilic. Preferably, at least the surfaces of the internal particles 13 are hydrophilic. In the case of non-hydrophilic internal particles, surfaces thereof are preferably hydrophilized. The hydrophilicity of at least the surfaces of the internal particles 13 provides high compatibility of the internal particles 13 with an aqueous medium in which the material of the shell layers 12 is dispersed in the formation of the shell layers 12. As a result, the internal particles 13 can be prevented from shedding from the shell layers 12.

The amount of the internal particles 13 located within the shell layers 12 is preferably no less than 0.5% by mass and no greater than 5% by mass relative to the total amount of the toner in order to control the distribution of the projections 15 of the toner particles 10 within a preferable range.

Hereinafter, the external additive 14 will be described. The external additive 14 is used in order to improve the fluidity or the handleability of the toner particles 10 and externally added to the surfaces of the shell layers 12. In order to improve the fluidity or the handleability, the amount of the external additive 14 is preferably no less than 0.5 parts by mass and no greater than 10 parts by mass, and more preferably no less than 2 part by mass and no greater than 5 parts by mass relative to 100 parts by mass of the toner mother particles.

Preferably, the external additive 14 includes for example silica or a metal oxide (e.g., alumina, titanium oxide, magnesium oxide, zinc oxide, strontium titanate, or barium titanate).

In order to improve the fluidity or the handleability of the toner, in addition, the external additive 14 preferably has a particle diameter of no less than 6 nm and no greater than 15 nm.

Next, a method of manufacturing the toner according to the present embodiment will be described.

In the method of manufacturing the toner according to the present embodiment, the toner cores 11 are prepared first. The toner cores 11 can be prepared by a melt-kneading method or an aggregation method, for example. Subsequently, the internal particles 13 are attached to the surfaces of the toner cores 11. Subsequently, the shell layers 12 are formed over the surfaces of the toner cores 11 in such a manner that the internal particles 13 are located within the shell layers 12. Thereafter, the external additive 14 is attached to the surfaces of the shell layers 12 to prepare the toner particles 10. It should be noted here that the internal particles 13 are attached to the surfaces of the toner cores 11 so that each of the toner particles 10 has 4 to 169 projections 15 resulting from the internal particles 13 and having a height (height h of the projections 15) of no less than 40 nm and no greater than 200 nm, and the projections 15 satisfy the following equation (1).

$$\{(1000/2Y)-0.5\}^2 \leq X \leq \{(1000/2Y)+0.5\}^2 \quad (1)$$

In the equation (1), X represents the number of the projections 15, and Y represents the height h of the projections 15.

The height h of the projections 15 can be determined by observing the regions A of the surfaces of the toner particles 10 without the external additive 14 using a scanning probe microscope.

In the method of manufacturing the toner of the present embodiment, the distribution of the projections 15 of the toner particles 10 can be suitably adjusted by controlling at least one of the particle diameter and the amount of the internal particles 13. In this way, each of the toner particles 10 can have 4 to 169 projections 15 resulting from the internal particles 13 and having a height of no less than 40 nm and no greater than 200 nm, and the projections 15 can satisfy the equation (1). The amount of the internal particles 13 added is substantially the same as the amount of the internal particles 13 present in the toner to be eventually obtained.

The shell layers 12 are formed by adding the toner cores 11 and the material of the shell layers 12 to a liquid (solvent), for example. Subsequently, the material of the shell layers 12 is polymerized on the surfaces of the toner cores 11 under stirring at a predetermined constant temperature. Thus, the shell layers 12 are formed over the surfaces of the toner cores 11.

Preferably, the shell layers 12 are formed by a method that can adjust the average particle diameter and the particle diameter distribution of the toner within a desired range. The shell layers 12 are preferably formed by in-situ polymerization, in-liquid curing, or coacervation. In particular, the in-situ polymerization is more preferable.

The material of the shell layers 12 is preferably one that allows easy layer formation (film formation) over the surfaces of the toner cores 11 and that effectively prevents aggregation of the toner. Preferable examples of the material of the shell layers 12 include resin raw materials (e.g., prepolymers or monomers) based on melamine, urea (e.g., urea-resorcinol), urethane, amide, olefin, or gelatin-gum Arabic. In particular, the melamine-based resin raw materials and the urea-based (urea-resorcinol-based) resin raw materials have low water-absorption and good storage stability. The use of the material of the shell layers 12 having low water-absorption has the following effects. That is, toner aggregation (bonding between the toner particles 10) can be reduced. The average particle diameter and the particle diameter distribution can be less variable. In addition, toner aggregation during storage can be restricted.

The material of the shell layers 12 is preferably a methylol compound such as methylol melamine (a precursor generated through an addition reaction of melamine and formaldehyde) or methylol urea (a precursor generated through an addition reaction of urea and formaldehyde). The methylol compound is readily formed into films on the surfaces of the toner cores 11.

Preferably, the material of the shell layers 12 is water dispersible. In the method of manufacturing the toner according to the present embodiment, the material of the shell layers 12 dispersed in an aqueous medium reacts to resinify on the surfaces of the toner cores 11. It is therefore preferable to use a highly hydrophilic material as the material of the shell layers 12. Such a material of the shell layers 12 is easy to disperse in an aqueous medium.

Preferably, the shell layers 12 are formed in a liquid in which the material of the shell layers 12 (e.g., methylol compound) can be dissolved. Preferably, the liquid is an aqueous medium (e.g., water, methanol, or ethanol).

The temperature of the film formation with the methylol melamine or the methylol urea is preferably no less than 40° C. and no greater than 80° C., and more preferably no less than 55° C. and no greater than 70° C. in order to increase the rate of the formation of the shell layers 12.

Preferably, the toner cores 11 are dispersed in the medium homogeneously in order to achieve a uniform film thickness of the shell layers 12. A dispersant may be added to the solvent in order to increase the dispersibility of the toner cores 11. The amount of the dispersant is preferably no greater than 75 parts by mass relative to 100 parts by mass of the toner cores 11.

Examples of the dispersant include sodium polyacrylate, polyparavinyl phenol, partially saponified polyvinyl acetate, isoprene sulfonic acid, polyether, isobutylene-maleic anhydride copolymer, sodium polyaspartate, starch, gum Arabic, polyvinylpyrrolidone, and sodium lignosulfonate. The dispersants may be used independently, or two or more of the dispersants may be used in combination.

EXAMPLES

Hereinafter, the present disclosure will be described in more detail by way of examples. It should be noted that the present disclosure is in no way limited to the scope of the examples.

(Preparation of Toner Cores)

Toner Cores A

The following raw materials were mixed using an FM mixer ("20B", product of Nippon Coke & Engineering Co., Ltd.) to give a mixture.

Polyester resin (binder resin, "TUFTONE (registered Japanese trademark) NE-410", product of Kao Corporation): 100 parts by mass Polypropylene wax (releasing agent, "VISCOL (registered Japanese trademark) 660P", product of Sanyo Chemical Industries, Ltd.): 5 parts by mass Carbon black (colorant, "REGAL (registered Japanese trademark) 330R", product of Cabot Japan K.K.): 5 parts by mass The mixture was melt-kneaded using a two-axis extruder ("PCM-30", product by Ikegai Corp.) to give a melt-kneaded product. The melt-kneaded product was rolled and cooled. Next, the rolled product was coarsely pulverized using a mechanical pulverizer ("Rotoplex (registered Japanese trademark) 16/8", product of Hosokawa Micron Corporation). Thereafter, the resulting coarsely pulverized product was finely pulverized using a jet mill (Model-I Super Sonic Jet Mill, product of Nippon Pneumatic Mfg.) The resulting finely pulverized product was classified using Elbow-Jet (EJ-LABO Model EJ-L-3), product of Nittetsu Mining Co., Ltd.)

to give toner cores A having a volume median diameter ($D_{50}$) of 6.5 μm. The toner cores A were anionic.

Toner Cores B

Toner cores B were prepared in substantially the same manner as in the preparation of the toner cores A except that the raw materials were changed as follows. Polyester resin (binder resin, "TUFTONE (registered Japanese trademark) NE-410", product of Kao Corporation): 100 parts by mass
Paraffin wax (releasing agent, "HNP-9", product by Nippon Seiro Co., Ltd.: 5 parts by mass
Carbon black (colorant, "REGAL (registered Japanese trademark) 330R", product of Cabot Japan K.K.): 5 parts by mass Toner Cores C Toner cores C were prepared in substantially the same manner as in the preparation of the toner cores A except that the raw materials were changed as follows.
Polyester resin (binder resin, "XPE258", product by Mitsui Chemicals, Inc.): 100 parts by mass
Polypropylene wax (releasing agent, "VISCOL (registered Japanese trademark) 660P", product of Sanyo Chemical Industries, Ltd.): 5 parts by mass
Carbon black (colorant, "REGAL (registered Japanese trademark) 330R", product of Cabot Japan K.K.): 5 parts by mass (Preparation of Internal Particles)

The following sol-gel silica particles A to E and titanium oxide particles A to D were prepared as the internal particles. All the particles were surface-hydrophilized
Sol-gel silica particles A: 50 nm in particle diameter
Sol-gel silica particles B: 100 nm in particle diameter
Sol-gel silica particles C: 200 nm in particle diameter
Sol-gel silica particles D: 250 nm in particle diameter
Sol-gel silica particles E: 20 nm in particle diameter
Titanium oxide particles A: "MT-700B", product of TAYCA CORPORATION, 80 nm in particle diameter
Titanium oxide particles B: "JA-C", product of TAYCA CORPORATION, 180 nm in particle diameter
Titanium oxide particles C: "JA-1", product of TAYCA CORPORATION, 270 nm in particle diameter
Titanium oxide particles D: "MT-500B", product of TAYCA CORPORATION, 35 nm in particle diameter The particle diameter was measured using a scanning electron microscope (SEM) ("JSM-7600F", product of JEOL Ltd.)

(Attachment of Internal Particles to Toner Cores)

The toner cores (one of the toner cores A to C) and the internal particles (one of the sol-gel silica particles A to E or the titanium oxide particles A to D) were mixed using a mixer ("FM mixer FM-10B", product of Nippon Coke & Engineering Co., Ltd.) at a rotation speed of 3500 rpm for 5 minutes. Thus, the internal particles are attached to the surfaces of the toner cores.

(Formation of Shell Layers)

Shell Layers A

To a 1-L three-necked flask equipped with a thermometer and a stirring impeller, 500 mL of ion exchanged water and 50 g of sodium polyacrylate ("JURYMER (registered Japanese trademark) AC-103", product of Toagosei Co., Ltd.) were added. As a result, an aqueous sodium polyacrylate solution was obtained in the flask.

Subsequently, 100 g of toner cores (one of the toner cores A to C) to which internal particles (one of the sol-gel silica particles A to E or the titanium oxide particles A to D) had been attached in the above-described manner were added to the aqueous sodium polyacrylate solution. Thereafter, the contents of the flask were sufficiently stirred at room temperature. As a result, a dispersion of the toner cores was obtained in the flask.

Subsequently, the dispersion of the toner cores was filtered using filter paper having a pore size of 3 μm. As a result, the toner cores were separated from the filtrate. Subsequently, the toner cores were re-dispersed in ion exchanged water. Thereafter, the filtering and the re-dispersing were repeated five times to wash the toner cores. Subsequently, a suspension of 100 g of the toner cores in 500 mL of ion exchanged water was prepared in a flask.

After adding 1 g of methylol urea ("Mirbane (registered Japanese trademark) resin SU-100", product of Showa Denko K.K.) to the flask, the contents of the flask were stirred to dissolve the methylol urea in the suspension. Subsequently, the suspension in the flask was adjusted to pH 4 through addition of dilute hydrochloric acid to the flask.

The suspension was then transferred to a 1-L separable flask. Next, the contents of the flask were heated (the internal temperature of the flask was increased up to 70° C.) under stirring at a stirring impeller rotation speed of 1200 rpm and maintained at 70° C. for 1 hour. The heating of the contents of the flask caused a polymerization reaction between the toner cores and the material of the shell layers (methylol urea) in the flask, and thus cationic shell layers including the thermosetting resin (urea resin) were formed over the surfaces of the toner cores. As a result, a dispersion containing toner mother particles was obtained. Thereafter, the dispersion was rapidly quenched to a normal temperature (25° C.).

The thickness of the shell layers can be adjusted by changing the ratio between the amount of the toner cores, the amount of the dispersant (e.g., aqueous sodium polyacrylate solution), and the amount of the material of the shell layers (e.g., methylol urea). For example, the shell layers are expected to have a thickness of approximately 8 nm when 100 parts by mass of the toner cores, the 50 parts by mass of the dispersant, and 1 part by mass of the material of the shell layers are added.

Shell Layers B

The shell layers B were formed in substantially the same manner as in the formation of the shell layers A except that partially saponified polyvinyl acetate ("GOHSENOL (registered Japanese trademark) GM-14L", product of Nippon Synthetic Chemical Industry Co., Ltd.) was used instead of the "JURYMER (registered Japanese trademark) AC-103", and methylol melamine ("Nikaresin S-260", product of Nippon Carbide Industries Co., Inc.) was used instead of the "MIRBANE (registered Japanese trademark) resin SUM-100", product of Showa Denko K.K.

Shell Layers C

The shell layers C were formed in substantially the same manner as in the formation of the shell layers A except that the "JURYMER (registered Japanese trademark) AC-103" (dispersant) was not used, and methylol melamine ("Polyfix (registered Japanese trademark) KAM-7", product of Showa Denko K.K., was used instead of the "MIRBANE (registered Japanese trademark) resin SUM-100".

(Solid-Liquid Separation)

After the shell layers were formed to prepare toner mother particles as described above, the dispersion was filtered (subjected to solid-liquid separation) to collect the toner mother particles. Thereafter, the toner mother particles were re-dispersed in ion exchanged water. The dispersing and the filtering were repeated to wash the toner mother particles. Next, the toner mother particles were dried. Since the washing (dispersing and filtering) was repeated, there was very little dispersant left within and on the surfaces of the toner mother particles.

(External Additive Addition)

To surfaces of the toner mother particles, 0.7% by mass of hydrophobic silica ("RA-200H", product of Nippon Aerosil Co., Ltd.) and 1.0% by mass of titanium oxide "EC-100", product of Titan Kogyo, Ltd.) were added as external additives relative to the total amount of the toner mother particles. The toner mother particles and the external additives were mixed together using an FM mixer ("FM-10B", product of Nippon Coke & Engineering Co., Ltd.) at a rotation speed of 3500 rpm for 5 minutes.

(Preparation of Sample Toners)

Toner 1

The toner 1 was prepared using the toner cores A, the shell layers A, and the sol-gel silica particles A. The amount of the sol-gel silica particles A was 1.0% by mass relative to the total amount of the toner.

Preparation of Two-Component Developer Containing Toner 1

A two-component developer containing the toner 1 was prepared. First, a carrier A was prepared. Specifically, 40 parts by mass of manganese(II) oxide, 9 parts by mass of magnesium oxide, 50 parts by mass of iron(III) oxide, and 1 part by mass of strontium oxide were mixed and pulverized using a ball mill for 2 hours. Thereafter, the resulting pulverized product was sintered at 1000° C. for 5 hours to give manganese ferrite carrier cores. The manganese ferrite carrier cores had a particle diameter of 35 μm. A solution of 3 parts by mass of a silicone resin in 20 parts by mass of toluene was sprayed onto 100 parts by mass of the carrier cores. Next, heating was performed at 200° C. for 60 minutes to give the carrier A.

The toner 1 and the carrier A were mixed so that the proportion of the toner 1 was 10% by mass (that is, the amount of the toner 1 was 10 parts by mass relative to 100 parts by mass of the total amount of the toner 1 and the carrier A), and further mixed under stirring for 1 hour using a Rocking Mixer (registered Japanese trademark) to give a two-component developer. Fogging in toner supply (anti-fogging property) and the printing resistance (durability) in an actual apparatus of the two-component developer were evaluated.

Toners Other than Toner 1 (Toners 2-65) and Two-Component Developers Respectively Containing Toners Other than Toner 1

The toners other than the toner 1 and the two-component developers respectively containing the toners other than the toner 1 were obtained in the same manner as in the toner 1 except that the toner cores, the shell layers, the type of the internal particles, and the amount of the internal particles were changed as shown in Tables 1 to 3. In the toners 61 to 65, no internal particles were attached to the toner cores, that is, no internal particles were present within the shell layers.

TABLE 1

| | Toner cores | Shell layers | Internal particles Type | Internal particles Amount |
|---|---|---|---|---|
| Toner 1 | Toner cores A | Shell layers A | Sol-gel silica particles A | 1.0% by mass |
| Toner 2 | | | | 1.5% by mass |
| Toner 3 | | | | 2.0% by mass |
| Toner 4 | | | Sol-gel silica particles B | 2.0% by mass |
| Toner 5 | | | | 3.0% by mass |
| Toner 6 | | | | 4.0% by mass |
| Toner 7 | | | Sol-gel silica particles C | 6.5% by mass |
| Toner 8 | | | | 7.5% by mass |
| Toner 9 | | | | 8.5% by mass |
| Toner 10 | | | Sol-gel silica particles D | 7.0% by mass |
| Toner 11 | | | | 9.0% by mass |

TABLE 1-continued

| | Toner cores | Shell layers | Internal particles Type | Internal particles Amount |
|---|---|---|---|---|
| Toner 12 | | | | 11% by mass |
| Toner 13 | | | Sol-gel silica particles E | 0.5% by mass |
| Toner 14 | | | | 0.75% by mass |
| Toner 15 | | | | 1.0% by mass |
| Toner 16 | Toner cores B | Shell layers A | Sol-gel silica particles B | 2.0% by mass |
| Toner 17 | | | | 3.0% by mass |
| Toner 18 | | | | 4.0% by mass |
| Toner 19 | | | Sol-gel silica particles D | 7.0% by mass |
| Toner 20 | | | | 9.0% by mass |
| Toner 21 | | | | 11% by mass |
| Toner 22 | | | Sol-gel silica particles E | 0.5% by mass |
| Toner 23 | | | | 0.75% by mass |
| Toner 24 | | | | 1.0% by mass |
| Toner 25 | Toner cores C | | Sol-gel silica particles B | 2.0% by mass |
| Toner 26 | | | | 3.0% by mass |
| Toner 27 | | | | 4.0% by mass |
| Toner 28 | | | Sol-gel silica particles D | 7.0% by mass |
| Toner 29 | | | | 9.0% by mass |
| Toner 30 | | | | 11.0% by mass |
| Toner 31 | | | Sol-gel silica particles E | 0.5% by mass |
| Toner 32 | | | | 0.75% by mass |
| Toner 33 | | | | 1.0% by mass |

TABLE 2

| | Toner cores | Shell layers | Internal Particles Type | Internal Particles Amount |
|---|---|---|---|---|
| Toner 34 | Toner cores A | Shell layers B | Sol-gel silica particles B | 2.0% by mass |
| Toner 35 | | | | 3.0% by mass |
| Toner 36 | | | | 4.0% by mass |
| Toner 37 | | | Sol-gel silica particles D | 7.0% by mass |
| Toner 38 | | | | 9.0% by mass |
| Toner 39 | | | | 11.0% by mass |
| Toner 40 | | | Sol-gel silica particles E | 0.5% by mass |
| Toner 41 | | | | 0.75% by mass |
| Toner 42 | | | | 1.0% by mass |
| Toner 43 | | Shell layers C | Sol-gel silica particles B | 2.0% by mass |
| Toner 44 | | | | 3.0% by mass |
| Toner 45 | | | | 4.0% by mass |
| Toner 46 | | | Sol-gel silica particles D | 7.0% by mass |
| Toner 47 | | | | 9.0% by mass |
| Toner 48 | | | | 11.0% by mass |
| Toner 49 | | | Sol-gel silica particles E | 0.5% by mass |
| Toner 50 | | | | 0.75% by mass |
| Toner 51 | | | | 1.0% by mass |
| Toner 52 | Toner cores A | Shell layers A | Titanium oxide particles A | 1.5% by mass |
| Toner 53 | | | | 2.5% by mass |
| Toner 54 | | | | 3.5% by mass |
| Toner 55 | | | Titanium oxide particles B | 6.0% by mass |
| Toner 56 | | | | 7.0% by mass |
| Toner 57 | | | | 8.0% by mass |
| Toner 58 | | | Titanium oxide particles C | 8.0% by mass |
| Toner 59 | | | | 10% by mass |
| Toner 60 | | | | 12% by mass |
| Toner 61 | | | Titanium oxide particles D | 0.5% by mass |
| Toner 62 | | | | 1.0% by mass |
| Toner 63 | | | | 1.5% by mass |

TABLE 3

| | Toner cores | Shell layers | Internal Particles Type | Internal Particles Amount |
|---|---|---|---|---|
| Toner 64 | Toner cores A | Shell layers B | Titanium oxide particles A | 1.5% by mass |
| Toner 65 | | | | 2.5% by mass |
| Toner 66 | | | | 3.5% by mass |
| Toner 67 | | | Titanium oxide particles B | 6.0% by mass |
| Toner 68 | | | | 7.0% by mass |

TABLE 3-continued

| | Toner cores | Shell layers | Internal Particles Type | Internal Particles Amount |
|---|---|---|---|---|
| Toner 69 | | | | 8.0% by mass |
| Toner 70 | | | Titanium oxide | 8.0% by mass |
| Toner 71 | | | particles C | 10.0% by mass |
| Toner 72 | | | | 12.0% by mass |
| Toner 73 | | | Titanium oxide | 0.5% by mass |
| Toner 74 | | | particles D | 1.0% by mass |
| Toner 75 | | | | 1.5% by mass |
| Toner 76 | | Shell | Titanium oxide | 1.5% by mass |
| Toner 77 | | layers C | particles A | 2.5% by mass |
| Toner 78 | | | | 3.5% by mass |
| Toner 79 | | | Titanium oxide | 6.0% by mass |
| Toner 80 | | | particles B | 7.0% by mass |
| Toner 81 | | | | 8.0% by mass |
| Toner 82 | | | Titanium oxide | 8.0% by mass |
| Toner 83 | | | particles C | 10.0% by mass |
| Toner 84 | | | | 12.0% by mass |
| Toner 85 | | | Titanium oxide | 0.5% by mass |
| Toner 86 | | | particles D | 1.0% by mass |
| Toner 87 | | | | 1.5% by mass |
| Toner 88 | Toner cores A | Shell layers A | None | — |
| Toner 89 | Toner cores B | | | — |
| Toner 90 | Toner cores C | | | — |
| Toner 91 | Toner cores A | Shell layers B | | — |
| Toner 92 | | Shell layers C | | — |

The symbol "-" in Table 3 indicates that no internal particles were used (no internal particles were present within the shell layers).

Each of the toners prepared as described above (hereinafter, may be referred to as toner sample) was evaluated as follows.

(1) Presence of Shell Layers

The toner particles of each toner sample was pressed using a pressing machine to give a slice having a thickness of approximately 100 nm. Where the pressing was impossible, the toner particles were embedded in a resin and cured, and then the cured product was cut using Ultramicrotome ("EM UC6", product of Leica Microsystems) to give a slice having a thickness of approximately 100 nm.

Subsequently, the slice was sufficiently dried on a metal mesh having a mesh size of no less than 100 mesh and no greater than 200 mesh. Then, a cross-sectional image of the slice (in particular, toner core surface) was captured at an accelerating voltage of 30 kV using a Schottky field emission scanning electron microscope ("JSM-7600F", product of JEOL Ltd.) Thus, a transmission electron microscope image (TEM image) at a predetermined magnification (approximately ×100000) was obtained. Each sample was observed more closely using a dedicated TEM as needed.

Whether or not the shell layers were formed over the surfaces of the toner cores was determined based on the transmission electron microscope image. The presence of the shell layers was determined by another method as needed. For example, the presence of the shell layers was determined by alkali soaking. The presence of the shell layers was also determined by determining the presence of nitrogen, which is contained in the shell layers, by electron energy loss spectroscopy (EELS).

(2) Height and Number of Projections of Surfaces of Toner Particles

A force curve of a surface of each of the toner mother particles was obtained (mapped) using a scanning probe microscope ("S-image", product of Hitachi High-Tech Science Corporation). The toner mother particles refer to each toner sample before the treatment with the external additive. Furthermore, a force curve of the region A located in the top surface (highest part) of each toner mother particle was obtained.

Subsequently, toner particles including shell layers having the same thickness and no internal particles within the shell layers (including shell layers directly on toner cores) were prepared and measured for the surface roughness in the above-described manner. The height of the projections was determined in accordance with the following equation (I).

$$\text{Height of projections} = (\text{surface roughness of toner particle including internal particles within shell layer}) - (\text{surface roughness of toner particle including no internal particles within shell layer}) \quad \text{I}$$

The height of the projections was measured for ten toner mother particles contained in each toner sample. An average value of the heights of the projections measured (measurement values of the ten toner mother particles) was calculated. When the accuracy of the measurement was considered insufficient for representing the distribution of the projections of the surfaces of the toner particles, the measurement was performed on more than ten toner particles.

(3) Rate of Stress-Induced Change (Stress Resistance)

A sample tube (capacity: 100 mL) was charged with 5 g of a toner sample and 50 g of a ferrite carrier ("FK-150", product of Powdertech Co., Ltd.), and the contents of the sample tube were stirred at 100 rpm and thus stressed for 30 minutes using a TURBULA mixer (product of Willy A. Bachofen AG). After the stiffing, only the toner sample was collected by suction through a filter having a pore size of 5 μm. The specific surface area of the toner collected was measured (through adsorption) using a BET specific surface area measuring device ("Macsorb HM model-1208", product of Mountech CO., Ltd.), and the rate of stress-induced change was determined in accordance with the following equation.

$$\text{Rate of stress-induced change (\%)} = (S_s/S_i) \times 100$$

$S_s$: (BET value of toner before stirring)−(BET value of toner after stirring)

$S_i$: (BET value of toner before stiffing)−(BET value of toner cores)

The stress resistance was evaluated according to the following criteria.

Good (G): A rate of stress-induced change of less than 20%

Normal (N): A rate of stress-induced change of no less than 20% and less than 40%

Poor (P): A rate of stress-induced change of no less than 40%.

(4) Fogging in Toner Supply (Anti-Fogging Property)

Each of the two-component developers (a two-component developer containing each of the toners prepared as described above) obtained as described above was put in a plastic container (capacity: 20 mL), and mixed under mild stirring for 10 minutes using a Rocking Mixer (registered Japanese trademark) (product of AICHI ELECTRIC CO., LTD.) Thereafter, the two-component developer was taken out from the plastic container and stirred (rotation speed: 180 rpm) for 10 minutes using a device for forcibly degrading the developer (prepared by KYOCERA Document Solutions Inc.) to forcibly degrade the two-component developer.

The amount of oppositely-charged toner in the two-component developer after the stirring was measured using an electric field separating device (prepared by KYOCERA Document Solutions Inc.) Specifically, 1.0 g of the two-component developer after the stirring was set on a magnet roll, and the magnet roll was rotated to uniformly spread the two-component developer thereon. Thereafter, an electric field was applied to the two-component developer for 30 seconds using an external power source (alternating-current voltage: 3.0 kV, direct-current voltage: −1.5 kV, frequency: 4 kHz, and duty cycle: 50%). As a result, the oppositely-charged toner is repelled from the magnet roll and scattered toward an outer electrode. The amount of the scattered toner was measured as the amount of the oppositely-charged toner. The anti-fogging property was evaluated according to the following criteria.

Good (G): An amount of oppositely-charged toner of less than 10 mg

Figure 4:
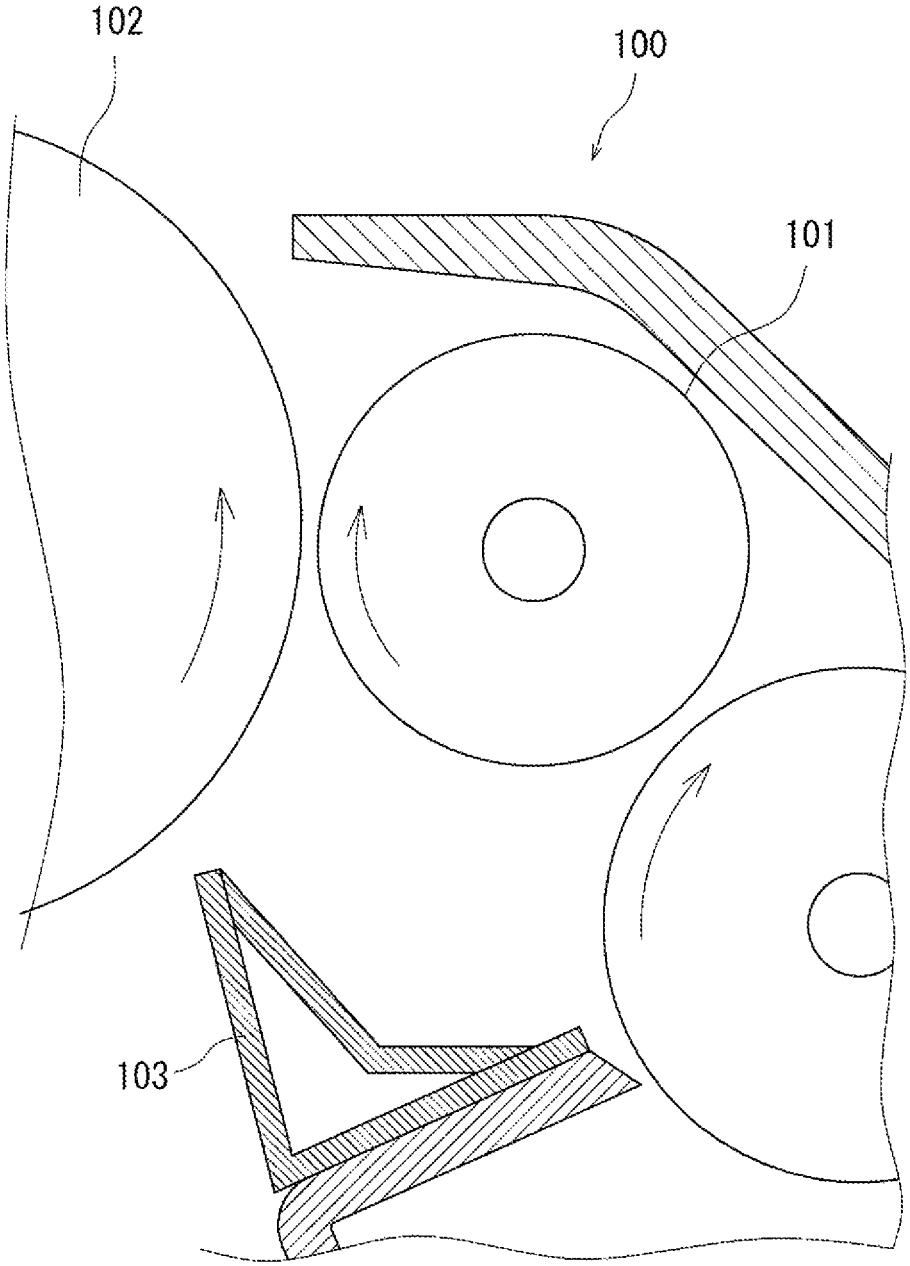
FIG. 4 is a diagram for illustrating a developing device used to evaluate the amount of scattered toner.

Normal (N): An amount of oppositely-charged toner of no less than 10 mg and less than 30 mg Poor (P): An amount of oppositely-charged toner of no less than 30 mg (5) Printing Resistance (Durability) in Actual Apparatus A multifunction peripheral ("TASKalfa5550ci", product of KYOCERA Document Solutions Inc.) was used as an evaluation apparatus. A developing device used for evaluation of the amount of scattered toner will be described with reference to FIG. 4. FIG. 4 illustrates a developing device 100 in the evaluation apparatus. As illustrated in FIG. 4, the developing device 100 includes a developing roller 101 and a photosensitive drum 102. The developing device 100 further includes a toner receiving section 103 under the developing roller 101. The toner scattered during the development was accumulated in the toner receiving section 103.

Each of the two-component developers prepared as described above was put in a cyan-color developing device in the evaluation apparatus, and each toner sample was put in a cyan-color toner container in the evaluation apparatus.

Hereinafter, methods of measuring the image density (ID), the fogging density (FD), and the amount of scattered toner using the evaluation apparatus will be described. The image density (ID) and the fogging density (FD) were measured using a spectrophotometer ("SpectroEye", product of SAKATA INX ENG. CO., LTD.) The amount of scattered toner (amount of toner accumulated in the toner receiving section 103) was measured. The amount of scattered toner was determined by collecting the toner accumulated in the toner receiving section 103 by suction using a compact toner draw-off charge measurement system ("Model 210HS Q/m Meter", product of TREK, INC.) and measuring the total amount of the toner collected.

For testing the printing resistance of the examples, the image density (ID) and the fogging density (FD) were measured at an initial stage, at a post-intermittent printing stage, and at a post-continuous printing stage. The amount of scattered toner was measured at the post-intermittent printing stage and at the post-continuous printing stage.

For testing an image at an initial stage, an evaluation image (No. 1 pictorial chart) was printed in a normal-temperature and normal-humidity (temperature: 23° C., humidity: 50% RH) environment using the evaluation apparatus. The image density (ID) of a solid part of the evaluation image printed was measured. In addition, a sample image including a solid part was printed continuously on 50 sheets of blank paper, and subsequently 10 sheets of blank paper were continuously output. The fogging density (FD) was measured at a predetermined point of each of the 10 sheets of blank paper output. The highest value of the fogging densities (FD) obtained was used as an evaluation value.

For testing intermittent printing, a sample image having a low coverage rate (0.2%) was printed intermittently on 50000 sheets of paper (printing paper) in a normal-temperature and normal-humidity environment (temperature: 23° C., humidity: 50% RH) using the evaluation apparatus. Thereafter, an evaluation image (No. 1 pictorial chart) was printed, and the image density (ID) of a solid part of the evaluation image printed was measured. In addition, a sample image including a solid part was printed continuously on 50 sheets of blank paper, and subsequently 10 sheets of blank paper were continuously output. The fogging density (FD) was measured at a predetermined point of each of the 10 sheets of blank paper output. The highest value of the fogging densities (FD) obtained was used as an evaluation value. The amount of scattered toner (amount of toner accumulated in the toner receiving section 103) was also measured.

For testing continuous printing, a sample image having a high coverage rate (20%) was printed continuously on 100000 sheets of paper (printing paper) in a normal-temperature and normal-humidity environment (temperature: 23° C., humidity: 50% RH) using the evaluation apparatus. Thereafter, an evaluation image (No. 1 pictorial chart) was printed, and the image density (ID) of a solid part of the evaluation image printed was measured. In addition, a sample image including a solid part was printed continuously on 50 sheets of blank paper, and subsequently 10 sheets of blank paper were continuously output. The fogging density (FD) was measured at a predetermined point of each of the 10 sheets of blank paper output. The highest value of the fogging densities (FD) obtained was used as an evaluation value. The amount of scattered toner (amount of toner accumulated in the toner receiving section 103) was also measured.

The image density was evaluated according to the following criteria.

Very good (VG): An ID of no less than 1.30

In this case, the image density was particularly high, and the image quality was very good.

Good (G): An ID of no less than 1.00 and less than 1.30

In this case, the image density was high, and the image quality was good.

Poor (P): An ID of less than 1.00

In this case, the image density was very low, and the image quality was poor.

The fogging density was evaluated according to the following criteria.

Very good (VG): An FD of less than 0.005

In this case, the FD was particularly low, and the image quality was very good.

Good (G): An FD of no less than 0.005 and less than 0.010

In this case, the FD was low, and the image quality was good.

Poor (P): An FD of no less than 0.010

In this case, the FD was very high, and the image quality was poor.

The amount of scattered toner was evaluated according to the following criteria. No practical problem was found in the cases other than that where the amount of scattered toner was evaluated as "P".

Very good (VG): An amount of scattered toner of less than 0.20 g

Good (G): An amount of scattered toner of no less than 0.20 g and less than 1.00 g Poor (P): An amount of scattered toner of no less than 1.00 g Tables 4 to 9 show evaluation results of the toners.

The symbol "-" in Tables 4 to 9 indicates that toner scattering was not evaluated for the initial-stage images.

TABLE 4

| | | | | Printing durability in actual apparatus | | | | | | | | |
|---|---|---|---|---|---|---|---|---|---|---|---|---|
| | | | | Initial-stage image | | | 0.2% (low coverage rate) intermittent printing 50000 sheets | | | 20% (high coverage rate) continuous printing 100000 sheets | | |
| | Projections (Height: nm-number) | Rate of stress-induced change | Fogging in toner supply | Image density | Fogging density | Amount of scattered toner | Image density | Fogging density | Amount of scattered toner | Image density | Fogging density | Amount of scattered toner |
| Toner 1 | 44-90 | 51 | 28 | 1.20 | 0.004 | — | 0.80 | 0.003 | 0.02 | 1.25 | 0.008 | 0.21 |
| Toner 2 | 44-132 | 30 | 20 | 1.43 | 0.007 | — | 1.31 | 0.005 | 0.06 | 1.48 | 0.014 | 0.50 |
| Toner 3 | 45-180 | 25 | 32 | 1.50 | 0.018 | — | 1.38 | 0.010 | 0.10 | 1.58 | 0.038 | 2.52 |
| Toner 4 | 95-20 | 41 | 22 | 1.31 | 0.006 | — | 0.97 | 0.005 | 0.04 | 1.36 | 0.010 | 0.20 |
| Toner 5 | 96-27 | 19 | 7 | 1.40 | 0.005 | — | 1.22 | 0.006 | 0.04 | 1.41 | 0.010 | 0.20 |
| Toner 6 | 96-40 | 15 | 28 | 1.42 | 0.009 | — | 1.32 | 0.009 | 0.09 | 1.49 | 0.029 | 1.83 |
| Toner 7 | 194-3 | 38 | 24 | 1.22 | 0.004 | — | 0.82 | 0.003 | 0.03 | 1.28 | 0.009 | 0.18 |
| Toner 8 | 196-6 | 25 | 9 | 1.36 | 0.004 | — | 1.18 | 0.004 | 0.02 | 1.33 | 0.008 | 0.11 |
| Toner 9 | 195-11 | 22 | 27 | 1.41 | 0.010 | — | 1.31 | 0.008 | 0.08 | 1.47 | 0.030 | 1.59 |
| Toner 10 | 248-2 | 48 | 10 | 1.18 | 0.002 | — | 0.70 | 0.002 | 0.03 | 1.19 | 0.008 | 0.20 |
| Toner 11 | 245-4 | 46 | 12 | 1.23 | 0.004 | — | 0.81 | 0.002 | 0.03 | 1.24 | 0.008 | 0.22 |
| Toner 12 | 244-6 | 40 | 17 | 1.26 | 0.005 | — | 0.89 | 0.002 | 0.04 | 1.29 | 0.009 | 0.23 |
| Toner 13 | 16-700 | 50 | 25 | 1.44 | 0.007 | — | 1.30 | 0.008 | 0.12 | 1.50 | 0.032 | 1.90 |
| Toner 14 | 15-1100 | 42 | 31 | 1.48 | 0.007 | — | 1.35 | 0.009 | 0.16 | 1.54 | 0.042 | 2.53 |
| Toner 15 | 14-1540 | 32 | 40 | 1.52 | 0.009 | — | 1.41 | 0.010 | 0.21 | 1.55 | 0.050 | 4.05 |
| Toner 16 | 96-19 | 42 | 21 | 1.21 | 0.003 | — | 0.86 | 0.002 | 0.04 | 1.26 | 0.009 | 0.18 |
| Toner 17 | 98-25 | 19 | 8 | 1.38 | 0.006 | — | 1.24 | 0.008 | 0.05 | 1.39 | 0.011 | 0.19 |

TABLE 5

| | | | | Printing durability in actual apparatus | | | | | | | | |
|---|---|---|---|---|---|---|---|---|---|---|---|---|
| | | | | Initial-stage image | | | 0.2% (low coverage rate) intermittent printing 50000 sheets | | | 20% (high coverage rate) continuous printing 100000 sheets | | |
| | Projections (Height: nm-number) | Rate of stress-induced change | Fogging in toner supply | Image density | Fogging density | Amount of scattered toner | Image density | Fogging density | Amount of scattered toner | Image density | Fogging density | Amount of scattered toner |
| Toner 18 | 96-41 | 15 | 26 | 1.43 | 0.009 | — | 1.35 | 0.007 | 0.09 | 1.45 | 0.030 | 1.59 |
| Toner 19 | 244-2 | 50 | 12 | 1.16 | 0.002 | — | 0.71 | 0.002 | 0.04 | 1.18 | 0.008 | 0.20 |
| Toner 20 | 245-4 | 45 | 17 | 1.21 | 0.003 | — | 0.82 | 0.002 | 0.03 | 1.23 | 0.008 | 0.22 |
| Toner 21 | 244-6 | 41 | 21 | 1.23 | 0.004 | — | 0.93 | 0.002 | 0.05 | 1.29 | 0.009 | 0.23 |
| Toner 22 | 15-725 | 52 | 24 | 1.45 | 0.006 | — | 1.33 | 0.007 | 0.13 | 1.48 | 0.034 | 1.95 |
| Toner 23 | 15-1080 | 44 | 29 | 1.48 | 0.007 | — | 1.36 | 0.008 | 0.18 | 1.56 | 0.046 | 2.70 |
| Toner 24 | 14-1620 | 38 | 34 | 1.54 | 0.010 | — | 1.40 | 0.009 | 0.23 | 1.60 | 0.056 | 4.40 |
| Toner 25 | 95-18 | 43 | 24 | 1.20 | 0.004 | — | 0.79 | 0.002 | 0.02 | 1.29 | 0.008 | 0.18 |
| Toner 26 | 98-26 | 18 | 7 | 1.40 | 0.005 | — | 1.23 | 0.007 | 0.05 | 1.41 | 0.010 | 0.22 |
| Toner 27 | 94-43 | 19 | 28 | 1.40 | 0.009 | — | 1.30 | 0.007 | 0.09 | 1.48 | 0.032 | 1.59 |
| Toner 28 | 243-2 | 52 | 13 | 1.16 | 0.002 | — | 0.72 | 0.002 | 0.02 | 1.21 | 0.007 | 0.20 |
| Toner 29 | 246-4 | 46 | 18 | 1.21 | 0.004 | — | 0.81 | 0.002 | 0.03 | 1.28 | 0.008 | 0.22 |
| Toner 30 | 245-6 | 42 | 21 | 1.24 | 0.007 | — | 0.91 | 0.002 | 0.04 | 1.34 | 0.008 | 0.23 |
| Toner 31 | 15-706 | 51 | 24 | 1.43 | 0.008 | — | 1.32 | 0.007 | 0.13 | 1.52 | 0.035 | 2.10 |
| Toner 32 | 15-1099 | 46 | 31 | 1.45 | 0.007 | — | 1.37 | 0.009 | 0.18 | 1.54 | 0.049 | 2.75 |
| Toner 33 | 14-1605 | 40 | 38 | 1.52 | 0.009 | — | 1.45 | 0.011 | 0.25 | 1.61 | 0.055 | 4.34 |
| Toner 34 | 96-18 | 42 | 22 | 1.20 | 0.003 | — | 0.85 | 0.002 | 0.04 | 1.27 | 0.008 | 0.17 |
| Toner 35 | 95-28 | 19 | 9 | 1.41 | 0.006 | — | 1.25 | 0.005 | 0.04 | 1.42 | 0.012 | 0.24 |

TABLE 6

| | | | | Printing durability in actual apparatus | | | | | | | | |
|---|---|---|---|---|---|---|---|---|---|---|---|---|
| | | | | Initial-stage Image | | | 0.2% (low coverage rate) intermittent printing 50000 sheets | | | 20% (high coverage rate) continuous printing 100000 sheets | | |
| | Projections (Height: nm-number) | Rate of stress-induced change | Fogging in toner supply | Image density | Fogging density | Amount of scattered toner | Image density | Fogging density | Amount of scattered toner | Image density | Fogging density | Amount of scattered toner |
| Toner 36 | 95-42 | 18 | 27 | 1.41 | 0.008 | — | 1.33 | 0.006 | 0.08 | 1.48 | 0.029 | 1.58 |
| Toner 37 | 243-1 | 55 | 20 | 1.18 | 0.002 | — | 0.70 | 0.002 | 0.04 | 1.25 | 0.009 | 0.21 |
| Toner 38 | 245-3 | 45 | 22 | 1.22 | 0.003 | — | 0.84 | 0.002 | 0.04 | 1.30 | 0.008 | 0.22 |
| Toner 39 | 244-5 | 40 | 27 | 1.26 | 0.003 | — | 0.93 | 0.002 | 0.05 | 1.34 | 0.009 | 0.24 |

TABLE 6-continued

| | | | | Printing durability in actual apparatus | | | | | | | | |
|---|---|---|---|---|---|---|---|---|---|---|---|---|
| | | | | Initial-stage Image | | | 0.2% (low coverage rate) intermittent printing 50000 sheets | | | 20% (high coverage rate) continuous printing 100000 sheets | | |
| | Projections (Height: nm-number) | Rate of stress-induced change | Fogging in toner supply | Image density | Fogging density | Amount of scattered toner | Image density | Fogging density | Amount of scattered toner | Image density | Fogging density | Amount of scattered toner |
| Toner 40 | 15-723 | 52 | 21 | 1.41 | 0.005 | — | 1.31 | 0.008 | 0.13 | 1.48 | 0.036 | 2.25 |
| Toner 41 | 15-1111 | 43 | 27 | 1.47 | 0.007 | — | 1.30 | 0.008 | 0.19 | 1.55 | 0.049 | 2.90 |
| Toner 42 | 14-1599 | 39 | 31 | 1.54 | 0.009 | — | 1.41 | 0.009 | 0.23 | 1.61 | 0.057 | 4.54 |
| Toner 43 | 96-21 | 35 | 23 | 1.21 | 0.004 | — | 0.81 | 0.002 | 0.03 | 1.28 | 0.009 | 0.17 |
| Toner 44 | 93-29 | 17 | 7 | 1.40 | 0.008 | — | 1.21 | 0.005 | 0.05 | 1.39 | 0.010 | 0.19 |
| Toner 45 | 96-40 | 30 | 29 | 1.40 | 0.009 | — | 1.30 | 0.007 | 0.07 | 1.47 | 0.030 | 1.58 |
| Toner 46 | 244-3 | 54 | 14 | 1.19 | 0.002 | — | 0.74 | 0.002 | 0.02 | 1.19 | 0.008 | 0.10 |
| Toner 47 | 245-4 | 47 | 17 | 1.24 | 0.005 | — | 0.82 | 0.002 | 0.03 | 1.24 | 0.008 | 0.24 |
| Toner 48 | 244-6 | 41 | 20 | 1.29 | 0.006 | — | 0.90 | 0.002 | 0.04 | 1.29 | 0.009 | 0.28 |
| Toner 49 | 15-705 | 53 | 20 | 1.43 | 0.006 | — | 1.28 | 0.005 | 0.14 | 1.50 | 0.032 | 2.40 |
| Toner 50 | 15-1064 | 44 | 25 | 1.48 | 0.007 | — | 1.34 | 0.008 | 0.17 | 1.54 | 0.042 | 3.01 |
| Toner 51 | 14-1553 | 38 | 31 | 1.53 | 0.008 | — | 1.41 | 0.010 | 0.22 | 1.55 | 0.050 | 4.13 |
| Toner 52 | 75-28 | 41 | 21 | 1.29 | 0.005 | — | 0.99 | 0.003 | 0.02 | 1.35 | 0.015 | 0.25 |

TABLE 7

| | | | | Printing durability in actual apparatus | | | | | | | | |
|---|---|---|---|---|---|---|---|---|---|---|---|---|
| | | | | Initial-stage Image | | | 0.2% (low coverage rate) intermittent printing 50000 sheets | | | 20% (high coverage rate) continuous printing 100000 sheets | | |
| | Projections (Height: nm-number) | Rate of stress-induced change | Fogging in toner supply | Image density | Fogging density | Amount of scattered toner | Image density | Fogging density | Amount of scattered toner | Image density | Fogging density | Amount of scattered toner |
| Toner 53 | 76-44 | 28 | 11 | 1.40 | 0.007 | — | 1.25 | 0.009 | 0.08 | 1.44 | 0.012 | 0.40 |
| Toner 54 | 74-58 | 30 | 28 | 1.43 | 0.011 | — | 1.35 | 0.009 | 0.09 | 1.50 | 0.025 | 1.54 |
| Toner 55 | 175-3 | 43 | 21 | 1.22 | 0.004 | — | 0.90 | 0.003 | 0.02 | 1.29 | 0.010 | 0.20 |
| Toner 56 | 174-9 | 25 | 12 | 1.36 | 0.004 | — | 1.22 | 0.007 | 0.08 | 1.40 | 0.008 | 0.23 |
| Toner 57 | 176-14 | 35 | 29 | 1.41 | 0.010 | — | 1.37 | 0.008 | 0.08 | 1.49 | 0.022 | 1.40 |
| Toner 58 | 268-1 | 65 | 11 | 1.10 | 0.002 | — | 0.68 | 0.001 | 0.02 | 1.15 | 0.007 | 0.20 |
| Toner 59 | 265-3 | 60 | 18 | 1.19 | 0.002 | — | 0.79 | 0.002 | 0.02 | 1.21 | 0.008 | 0.21 |
| Toner 60 | 262-5 | 52 | 23 | 1.23 | 0.003 | — | 0.85 | 0.002 | 0.04 | 1.26 | 0.010 | 0.25 |
| Toner 61 | 30-204 | 50 | 22 | 1.48 | 0.010 | — | 1.31 | 0.007 | 0.11 | 1.50 | 0.039 | 2.31 |
| Toner 62 | 29-309 | 44 | 29 | 1.53 | 0.012 | — | 1.36 | 0.009 | 0.16 | 1.57 | 0.045 | 3.05 |
| Toner 63 | 31-450 | 37 | 36 | 1.59 | 0.016 | — | 1.40 | 0.011 | 0.20 | 1.64 | 0.060 | 4.42 |
| Toner 64 | 74-26 | 44 | 22 | 1.28 | 0.004 | — | 1.00 | 0.002 | 0.02 | 1.34 | 0.015 | 0.23 |
| Toner 65 | 75-45 | 25 | 12 | 1.42 | 0.007 | — | 1.26 | 0.008 | 0.07 | 1.45 | 0.011 | 0.40 |
| Toner 66 | 75-60 | 35 | 29 | 1.42 | 0.010 | — | 1.32 | 0.008 | 0.07 | 1.51 | 0.025 | 1.69 |
| Toner 67 | 174-3 | 48 | 22 | 1.20 | 0.004 | — | 0.90 | 0.003 | 0.03 | 1.29 | 0.010 | 0.19 |

TABLE 8

| | | | | Printing durability in actual apparatus | | | | | | | | |
|---|---|---|---|---|---|---|---|---|---|---|---|---|
| | | | | Initial-stage Image | | | 0.2% (low coverage rate) intermittent printing 50000 sheets | | | 20% (high coverage rate) continuous printing 100000 sheets | | |
| | Projections (Height: nm-number) | Rate of stress-induced change | Fogging in toner supply | Image density | Fogging density | Amount of scattered toner | Image density | Fogging density | Amount of scattered toner | Image density | Fogging density | Amount of scattered toner |
| Toner 68 | 176-8 | 26 | 14 | 1.34 | 0.005 | — | 1.20 | 0.005 | 0.04 | 1.39 | 0.006 | 0.22 |
| Toner 69 | 175-13 | 40 | 27 | 1.39 | 0.008 | — | 1.37 | 0.007 | 0.09 | 1.48 | 0.022 | 1.80 |
| Toner 70 | 265-1 | 63 | 12 | 1.12 | 0.002 | — | 0.65 | 0.002 | 0.03 | 1.20 | 0.007 | 0.19 |
| Toner 71 | 264-3 | 58 | 19 | 1.18 | 0.002 | — | 0.76 | 0.002 | 0.03 | 1.25 | 0.008 | 0.21 |
| Toner 72 | 263-4 | 50 | 25 | 1.25 | 0.004 | — | 0.84 | 0.003 | 0.04 | 1.29 | 0.010 | 0.24 |
| Toner 73 | 29-192 | 54 | 22 | 1.47 | 0.010 | — | 1.30 | 0.006 | 0.10 | 1.51 | 0.040 | 2.35 |
| Toner 74 | 29-315 | 48 | 28 | 1.53 | 0.012 | — | 1.35 | 0.008 | 0.15 | 1.57 | 0.047 | 3.02 |

TABLE 8-continued

| | | | | Printing durability in actual apparatus | | | | | | | | |
|---|---|---|---|---|---|---|---|---|---|---|---|---|
| | | | | Initial-stage Image | | | 0.2% (low coverage rate) intermittent printing 50000 sheets | | | 20% (high coverage rate) continuous printing 100000 sheets | | |
| | Projections (Height: nm-number) | Rate of stress-induced change | Fogging in toner supply | Image density | Fogging density | Amount of scattered toner | Image density | Fogging density | Amount of scattered toner | Image density | Fogging density | Amount of scattered toner |
| Toner 75 | 30-512 | 40 | 34 | 1.58 | 0.016 | — | 1.40 | 0.010 | 0.19 | 1.64 | 0.059 | 4.49 |
| Toner 76 | 76-30 | 48 | 20 | 1.28 | 0.004 | — | 1.00 | 0.003 | 0.03 | 1.34 | 0.012 | 0.24 |
| Toner 77 | 74-45 | 24 | 11 | 1.42 | 0.008 | — | 1.27 | 0.008 | 0.06 | 1.44 | 0.012 | 0.44 |
| Toner 78 | 75-55 | 40 | 25 | 1.44 | 0.010 | — | 1.32 | 0.008 | 0.11 | 1.50 | 0.023 | 1.59 |
| Toner 79 | 174-2 | 49 | 23 | 1.23 | 0.004 | — | 0.95 | 0.003 | 0.03 | 1.30 | 0.008 | 0.21 |
| Toner 80 | 174-8 | 28 | 14 | 1.35 | 0.008 | — | 1.22 | 0.006 | 0.05 | 1.38 | 0.009 | 0.31 |
| Toner 81 | 175-13 | 39 | 28 | 1.40 | 0.009 | — | 1.30 | 0.007 | 0.08 | 1.50 | 0.021 | 1.43 |
| Toner 82 | 265-1 | 62 | 11 | 1.12 | 0.002 | — | 0.70 | 0.002 | 0.02 | 1.20 | 0.006 | 0.21 |
| Toner 83 | 264-3 | 55 | 18 | 1.17 | 0.003 | — | 0.81 | 0.003 | 0.03 | 1.25 | 0.008 | 0.23 |
| Toner 84 | 263-4 | 47 | 23 | 1.23 | 0.004 | — | 0.90 | 0.002 | 0.05 | 1.30 | 0.009 | 0.29 |

TABLE 9

| | | | | Printing durability in actual apparatus | | | | | | | | |
|---|---|---|---|---|---|---|---|---|---|---|---|---|
| | | | | Initial-stage Image | | | 0.2% (low coverage rate) intermittent printing 50000 sheets | | | 20% (high coverage rate) continuous printing 100000 sheets | | |
| | Projections (Height: nm-number) | Rate of stress-induced change | Fogging in toner supply | Image density | Fogging density | Amount of scattered toner | Image density | Fogging density | Amount of scattered toner | Image density | Fogging density | Amount of scattered toner |
| Toner 85 | 30-211 | 48 | 22 | 1.44 | 0.009 | — | 1.30 | 0.006 | 0.10 | 1.52 | 0.039 | 2.40 |
| Toner 86 | 29-309 | 40 | 30 | 1.51 | 0.011 | — | 1.30 | 0.009 | 0.18 | 1.56 | 0.048 | 3.01 |
| Toner 87 | 30-437 | 35 | 39 | 1.55 | 0.014 | — | 1.39 | 0.010 | 0.22 | 1.63 | 0.061 | 4.30 |
| Toner 88 | None | 80 | 20 | 1.15 | 0.002 | — | 0.70 | 0.002 | 0.02 | 1.20 | 0.005 | 0.20 |
| Toner 89 | | 85 | 22 | 1.12 | 0.002 | — | 0.68 | 0.001 | 0.03 | 1.19 | 0.006 | 0.18 |
| Toner 90 | | 79 | 28 | 1.21 | 0.004 | — | 0.72 | 0.002 | 0.02 | 1.21 | 0.005 | 0.21 |
| Toner 91 | | 70 | 22 | 1.14 | 0.004 | — | 0.68 | 0.002 | 0.02 | 1.19 | 0.004 | 0.22 |
| Toner 92 | | 75 | 26 | 1.10 | 0.002 | — | 0.60 | 0.002 | 0.03 | 1.19 | 0.005 | 0.20 |

As shown in Tables 4 to 9, the toners 2, 5, 8, 17, 26, 35, 44, 53, 56, 65, 68, 72, 77, 80, and 84 satisfy the following conditions.

Condition (1) The toner contains a plurality of toner particles.

Condition (2) Each of the toner particles includes a toner core containing a binder resin, a shell layer disposed over a surface of the toner core, internal particles located within the shell layer, and an external additive located on a surface of the shell layer.

Condition (3) Each of the toner particles has 4 to 169 projections resulting from the internal particles and having a height resulting from the internal particles of no less than 40 nm and no greater than 200 nm when a 1-$\mu m^2$ region of the surface of the toner particle is observed.

Condition (4) The projections satisfy the equation (1).

These toners each had the following evaluation result (1) or (2).

(1) All of the rate of stress-induced change, the fogging in toner supply, the image density, the fogging density, and the amount of scattered toner were evaluated as "Very Good", "Good", or "Normal".

(2) The rate of stress-induced change and the fogging in toner supply were evaluated as "Good" or "Normal". All of the image density, the fogging density, and the amount of scattered toner of the initial-stage image and the image after 0.2% (low coverage rate) 50000-sheet intermittent printing for the printing durability in the actual apparatus were evaluated as "Very Good" or "Good". At most one of the image density, the fogging density, and the amount of scattered toner of the image after 20% (high coverage rate) 100000-sheet continuous printing for the printing durability in the actual apparatus was evaluated as "Poor".

On the other hand, the toners 1, 3, 4, 6, 7, 9-16, 18-25, 27-34, 36-43, 45-52, 54, 55, 57-64, 66, 67, 69-71, 73-76, 78, 79, 81-83, and 85-92 do not satisfy the conditions (1) to (4). These toners each had the following evaluation result (3), (4), or (5).

(3) The rate of stress-induced change or the fogging in toner supply was evaluated as "Poor".

(4) One or more of the image density, the fogging density, and the amount of scattered toner of the initial-stage image and the image after 0.2% (low coverage rate) 50000-sheet intermittent printing for the printing durability in the actual apparatus was evaluated as "Poor".

(5) At least two of the image density, the fogging density, and the amount of scattered toner of the image after 20% (high coverage rate) 100000-sheet continuous printing for the printing durability in the actual apparatus were evaluated as "Poor".

Accordingly, the toners such as the toner 2 that satisfy the conditions (1) to (4) achieved better results in the evaluations of the rate of stress-induced change, the anti-fogging property, the image density, the fogging density, and the amount of scattered toner than the toners such as the toner 1 that do not satisfy the conditions (1) to (4). Thus, the toners satisfying the conditions (1) to (4) are capable of maintaining stable chargeability and excellent in anti-fogging property and durability.

What is claimed is:

1. A toner comprising a plurality of toner particles, each of the toner particles including:

a toner core containing a binder resin;

a shell layer disposed over a surface of the toner core;

internal particles located within the shell layer; and an external additive located on a surface of the shell layer, wherein each of the toner particles has 4 to 169 projections resulting from the internal particles and having a height of no less than 40 nm and no greater than 200 nm when a 1-$\mu m^2$ region of the surface of the toner particle is observed, and the projections satisfy the following equation (1)

$$\{(1000/2Y)-0.5\}^2 \leq X \leq \{(1000/2Y)+0.5\}^2 \quad (1)$$

wherein X represents the number of the projections, and Y represents the height of the projections.

2. A toner according to claim 1, wherein at least surfaces of the internal particles are hydrophilic.

3. A toner according to claim 1, wherein the internal particles have an average particle diameter of no less than 10 nm and no greater than 20 nm.

4. A toner according to claim 1, wherein the amount of the internal particles in the toner is no less than 0.5% by mass and no greater than 5% by mass relative to the total amount of the toner.

5. A toner according to claim 1, wherein the shell layer contains a thermosetting resin.

6. A method of manufacturing a toner, comprising in order:

attaching internal particles to surfaces of toner cores;

forming shell layers over the surfaces of the toner cores in such a manner that the internal particles are located within the shell layers; and attaching an external additive to surfaces of the shell layers to give toner particles, wherein in the attaching internal particles, the internal particles are attached so that each of the toner particles has 4 to 169 projections resulting from the internal particles and having a height of no less than 40 nm and no greater than 200 nm when a 1-$\mu m^2$ region of the surface of the toner particle is observed, and the projections satisfy the following equation (1)

$$\{(1000/2Y)-0.5\}^2 \leq X \leq \{(1000/2Y)+0.5\}^2 \quad (1)$$

wherein X represents the number of the projections, and Y represents the height of the projections.

* * * * *